US011033066B2

(12) United States Patent
Parke

(10) Patent No.: US 11,033,066 B2
(45) Date of Patent: Jun. 15, 2021

(54) ORTHOTIC INSOLE FOR A WOMAN'S SHOE

(71) Applicant: MARION PARKE DESIGNS, LLC, Minneapolis, MN (US)

(72) Inventor: Marion Garrett Parke, Minneapolis, MN (US)

(73) Assignee: MARION PARKE DESIGNS, LLC, Minneapolis, MN (US)

( * ) Notice: Subject to any disclaimer, the term of this patent is extended or adjusted under 35 U.S.C. 154(b) by 442 days.

(21) Appl. No.: 15/085,432

(22) Filed: Mar. 30, 2016

(65) Prior Publication Data

US 2016/0206038 A1 Jul. 21, 2016

Related U.S. Application Data

(63) Continuation-in-part of application No. 14/553,275, filed on Nov. 25, 2014.

(51) Int. Cl.
*A43B 3/00* (2006.01)
*A43B 7/14* (2006.01)
(Continued)

(52) U.S. Cl.
CPC ..... *A43B 3/0063* (2013.01); *A43B 7/141* (2013.01); *A43B 7/142* (2013.01); *A43B 13/41* (2013.01); *A43B 17/006* (2013.01)

(58) Field of Classification Search
CPC ..... A43B 7/141; A43B 7/142; A43B 7/143; A43B 7/144; A43B 7/148; A43B 13/41; A43B 17/006
See application file for complete search history.

(56) References Cited

U.S. PATENT DOCUMENTS 2,009,789 A 7/1935 Saladino
2,343,790 A 3/1944 Nicholl
(Continued)

FOREIGN PATENT DOCUMENTS

GB 404406 1/1934

OTHER PUBLICATIONS

International Search Report and Written Opinion for International Patent Application No. PCT/US2015/060585; dated Jan. 29, 2016.

*Primary Examiner* — Megan E Lynch
(74) *Attorney, Agent, or Firm* — Barnes & Thornburg LLP; Jason Bernstein

(57) ABSTRACT

An orthotic insole comprising top, middle, and bottom layers. The top layer is in contact with a wearer's foot or a wrap of material, the bottom layer is adjacent to an outsole of the shoe, and the middle layer is positioned therebetween. The top layer has substantially the same width and length of the entire insole. The middle layer is a generally j-shaped strip which provides a rearfoot posting within the insole and a cupping effect to a wearer's heel. The middle layer may have a similar overall width as the top layer but may include a shorter length than the top layer such that the middle layer only extends from the heel to approximately the joint of the fifth metatarsal bone. The bottom layer may be more rigid than the other two layers, and may further include a rigid plate. The insole may further include an arch support integrally formed within one or more of the layers or a cushioning layer with one or more cushioning segments on top of the top layer.

21 Claims, 11 Drawing Sheets

(51) Int. Cl.
*A43B 17/00* (2006.01)
*A43B 13/41* (2006.01)

(56) References Cited

U.S. PATENT DOCUMENTS 2,366,096 A 12/1944 Gerber
2,413,534 A 12/1946 Watson
2,425,837 A * 8/1947 Scholl ..... A43B 7/142 36/173
2,447,954 A 8/1948 Meldman
2,672,698 A 3/1954 Watson
2,857,689 A * 10/1958 Ostrom ..... A43B 7/1415 36/176
2,878,593 A 3/1959 Lockridge
2,917,757 A 12/1959 Scholl
2,949,685 A * 8/1960 Burns ..... A43B 7/1415 36/178
3,170,178 A 2/1965 Scholl
3,292,277 A 12/1966 Teschon
3,398,469 A 8/1968 Bressan
3,442,031 A 5/1969 Antell
3,828,792 A * 8/1974 Valenta ..... A43B 7/14 36/178
4,360,027 A * 11/1982 Friedlander ..... A43B 7/14 36/140
4,563,787 A 1/1986 Drew
4,597,196 A * 7/1986 Brown ..... A43B 1/0072 36/140
4,633,877 A * 1/1987 Pendergast ..... A43B 7/14 36/140
4,766,679 A * 8/1988 Bender ..... A43B 3/0063 36/30 R
4,942,679 A 7/1990 Brandon et al.
5,036,603 A 8/1991 Dischler
5,036,851 A * 8/1991 Cohen ..... A43B 7/1415 36/161
5,138,774 A 8/1992 Sarkozi
5,164,878 A 11/1992 Hauser
5,184,409 A * 2/1993 Brown ..... A43B 7/142 36/173
D353,259 S 12/1994 Schroer, Jr.
5,724,753 A 3/1998 Throneburg et al.
5,733,647 A 3/1998 Moore, III et al.
5,901,394 A 5/1999 Greenawalt
6,000,147 A 12/1999 Kellerman
6,176,025 B1 1/2001 Patterson et al.
6,484,419 B1 11/2002 Rohde et al.
6,510,626 B1 1/2003 Greenawalt
6,560,902 B1 5/2003 Eschweiler
D571,989 S 7/2008 Siegal
D668,849 S 10/2012 Pozzi
D668,850 S 10/2012 Pozzi
D701,028 S 3/2014 Remington et al.
8,800,170 B1 8/2014 Khaitan et al.
9,215,908 B1 12/2015 Malmoux
2003/0105193 A1 6/2003 Wang
2004/0118017 A1* 6/2004 Dalton ..... A43B 7/142 36/44
2004/0181971 A1 9/2004 Turkbas et al.
2004/0211086 A1 10/2004 Dananberg
2005/0000114 A1 1/2005 Mick et al.
2005/0138844 A1 6/2005 Johnson
2005/0281988 A1 12/2005 McCormick
2006/0026867 A1* 2/2006 Polcek ..... A43B 7/1445 36/44
2006/0123664 A1* 6/2006 Boyd ..... A43B 7/1425 36/44
2006/0156583 A1 7/2006 Butash
2006/0288613 A1 12/2006 Lo
2007/0011918 A1 1/2007 Snow et al.
2007/0033834 A1* 2/2007 Cheskin ..... A43B 7/141 36/44
2007/0084084 A1 4/2007 Rich
2007/0107261 A1* 5/2007 Cheskin ..... A43B 7/141 36/44
2007/0277400 A1* 12/2007 Nguyen ..... A43B 7/142 36/145
2008/0052963 A1 3/2008 Chiang
2008/0127527 A1 6/2008 Chen
2008/0148599 A1 6/2008 Collins
2009/0007455 A1 1/2009 Montgomery
2009/0049712 A1* 2/2009 Steszyn ..... A43B 7/142 36/91
2009/0282705 A1 11/2009 Trigillo
2010/0064550 A1 3/2010 Kahn et al.
2010/0122475 A1 5/2010 Purrington et al.
2010/0154252 A1* 6/2010 Avent ..... A43B 7/14 36/91
2010/0180467 A1 7/2010 Singleton
2010/0269375 A1* 10/2010 Georgoulakis ..... A43B 7/142 36/30 R
2010/0275468 A1 11/2010 Shelton et al.
2011/0061264 A1 3/2011 Solymosi et al.
2011/0209360 A1 9/2011 Baker et al.
2011/0219642 A1 9/2011 Sulak et al.
2011/0258879 A1* 10/2011 Dananberg ..... A43B 7/141 36/91
2012/0174436 A1 7/2012 Hanak
2012/0304493 A1 12/2012 Hudson et al.
2013/0008050 A1 1/2013 Marc
2013/0074367 A1* 3/2013 Yeh ..... A43B 3/0057 36/44
2013/0256947 A1* 10/2013 De Santis ..... B29C 45/1615 264/255
2013/0263470 A1 10/2013 Durocher
2014/0209229 A1 7/2014 Yang
2014/0245631 A1 9/2014 Joseph et al.
2014/0250722 A1 9/2014 Lin
2014/0259758 A1* 9/2014 Yeh ..... A43B 17/006 36/44
2015/0026998 A1 1/2015 Lin
2015/0201702 A1* 7/2015 Paul ..... A43B 17/02 36/44
2015/0237959 A1* 8/2015 Wynn ..... A43B 7/142 36/44

* cited by examiner

ORTHOTIC INSOLE FOR A WOMAN'S SHOE

CROSS-REFERENCE TO RELATED APPLICATION

This application is a continuation-in-part of copending application Ser. No. 14/553,275, filed on Nov. 25, 2014, titled ORTHOTIC INSOLE FOR A WOMAN'S SHOE, and commonly assigned to the assignee of the present application, the disclosure of which is incorporated by reference in its entirety herein.

FIELD

The present disclosure generally relates to an orthotic insole for a woman's shoe. More particularly, exemplary embodiments of the present disclosure relate to a built-in, orthotic insole for a women's high heel or elevated shoe.

BACKGROUND

Women's shoes, and in particular women's high-heel shoes, can cause various concerns for a wearer that create or exacerbate physical or medical issues relating to the wearer's foot and ankle. Extended wear of a high heel can cause a range of ailments, including for example, damage to the ankle, leg tendons, and foot tendons, or issues in the legs and back due to improper distribution of the wearer's weight. High-heeled shoes tend to put a foot in a plantar-flexed (foot pointed downward) position, shifting the body weight away from the heel to the balls of the foot. When a woman wears high heels, her arch height is increased, which alters her posture and gait. Furthermore, an increased arch height can lead to an unnatural increase in pressure to other areas of the foot, muscle fatigue and foot and ankle injury. High heel shoes also cause a wearer's foot and ankle to move in a supinated (turned outward) position. Thus, as it is well known, wearing high heel shoes can lead to an increased risk of ankle sprain or falls due to imbalance or instability.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to the more detailed description below.

In illustrative embodiments, a built-in orthotic insole for a women's high-heel or elevated shoe is provided that may limit or counteract some of the issues that may be more prevalent for women wearing high heels. The orthotic insole may be configured in a variety of embodiments.

In an illustrative embodiment, the orthotic insole may be comprised of three layers of material, with the inner layer including a closed-cell foam material, such as, but not limited to ethylene vinyl acetate. In illustrative embodiments, this material is commercially available as P-Cell® or a similar material that has an approximate durometer of 20. The insole may further comprise an arch fill or arch support. The arch fill may consist of Microcell Puff™ or other similar material that has an approximate durometer of 35, in illustrative embodiments. The arch support may be configured to approximately extend laterally below the base of the forth metatarsal bone of the user of the high-heel shoe. The insole further includes a rear foot post or posting, which in illustrative embodiments may be made of ethylene vinyl acetate with a durometer of approximately 55, that is a 3-degree post. In illustrative embodiments, the insole may be a full-length insole, or may be a sulcus-length insole that extends to approximately the digital sulcus of a user's foot. The features as described minimize potential slippage of the user's foot into the toe box and/or reduce ankle instability as it occurs in a high-heeled shoe.

In another illustrative embodiment, the orthotic insole may be comprised of three layers of material, a top layer, a middle layer, and a bottom layer. The top layer may be configured to be in contact with a wearer's foot or a wrap of material, the bottom layer may be configured to be adjacent an outsole of the shoe, and the middle layer may be configured to be positioned therebetween, with all three layers assembled together to form the insole. The top layer is configured to have substantially the same width and length of the entire insole, and may be constructed of one or more materials suitable to support a wearer's foot, such as flexible material, resistant material, or a combination of materials. The top layer may alternatively be constructed of multiple sublayers of material. The middle layer is shaped as a j-strip which provides a rearfoot posting within the insole and further provides a cupping effect to a wearer's heel. The middle layer may have a similar overall width as the top layer but may include a shorter length than the top layer such that the middle layer only extends from the heel to approximately the metatarsal phalangeal joint of the fifth metatarsal bone. The bottom layer may be configured to be more rigid than the other two layers to provide stability for the insole, and may further include a rigid plate that provides shaping and/or stiffening to the insole. The insole may further include an arch support integrally formed within one or more of the layers to provide support to a wearer's arch.

In another illustrative embodiment, a shoe with an orthotic insole may further include a cushioning layer positioned on top of a top layer of the insole. The cushioning layer includes a first cushion segment and a second cushion segment, wherein the first cushion segment may be positioned to be below the wearer's arch and the second cushion segment positioned may be positioned to be below the plantar aspect of the wearer's foot, sparing the arch. In various embodiments, a gap is formed between the first and second cushion segments. Further, a wrap may partially cover a portion of the first cushion segment, and an optional sock may cover a portion of the second cushion segment.

While the insole is configured to be permanently fixed in the high-heel shoe, the shape and size of the insole may be modified based on the shape and size of the shoe. The insole may further be covered in a wrap of leather or other similar material before being inserted into the shoe. Given the cosmetic element desired when wearing high heels, the non-removable insole may be covered in the same fabrics and materials as the upper part of the shoe. In such a manner, the wrapped insole avoids showing unattractive adhesive pads and also eliminates slippage of such removable pads.

BRIEF DESCRIPTION OF THE DRAWINGS

The drawings disclose exemplary embodiments in which like reference characters designate the same or similar parts throughout the figures of which.

DETAILED DESCRIPTION

Unless otherwise indicated, the drawings are intended to be read (for example, cross-hatching, arrangement of parts, proportion, degree, or the like) together with the specification, and are to be considered a portion of the entire written description. As used herein, the terms "horizontal", "vertical", "left", "right", "bottom", "middle", "top", "up" and "down", as well as adjectival and adverbial derivatives thereof (for example, "horizontally", "rightwardly", "upwardly", or the like), simply refer to the orientation of the illustrated structure as the particular drawing figure faces the reader. Furthermore, while exemplary embodiments herein describe a women's high-heeled shoe, it is intended that the shoe can be adapted as a shoe for use by a man.

Figure 1:
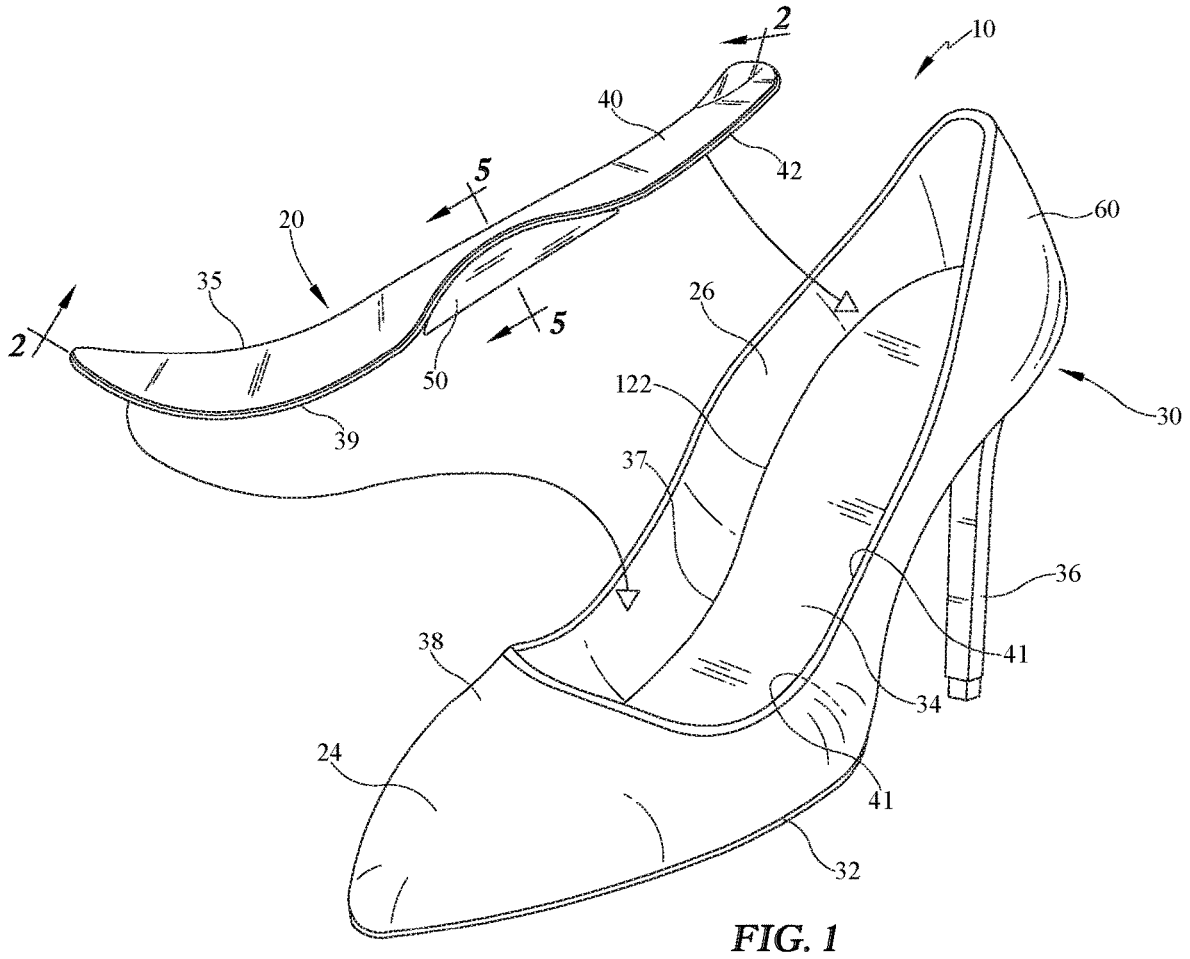
FIG. 1 is a disassembled view of a women's right high heel shoe with a full-length orthotic insole according to a first exemplary embodiment.
Figure 2:
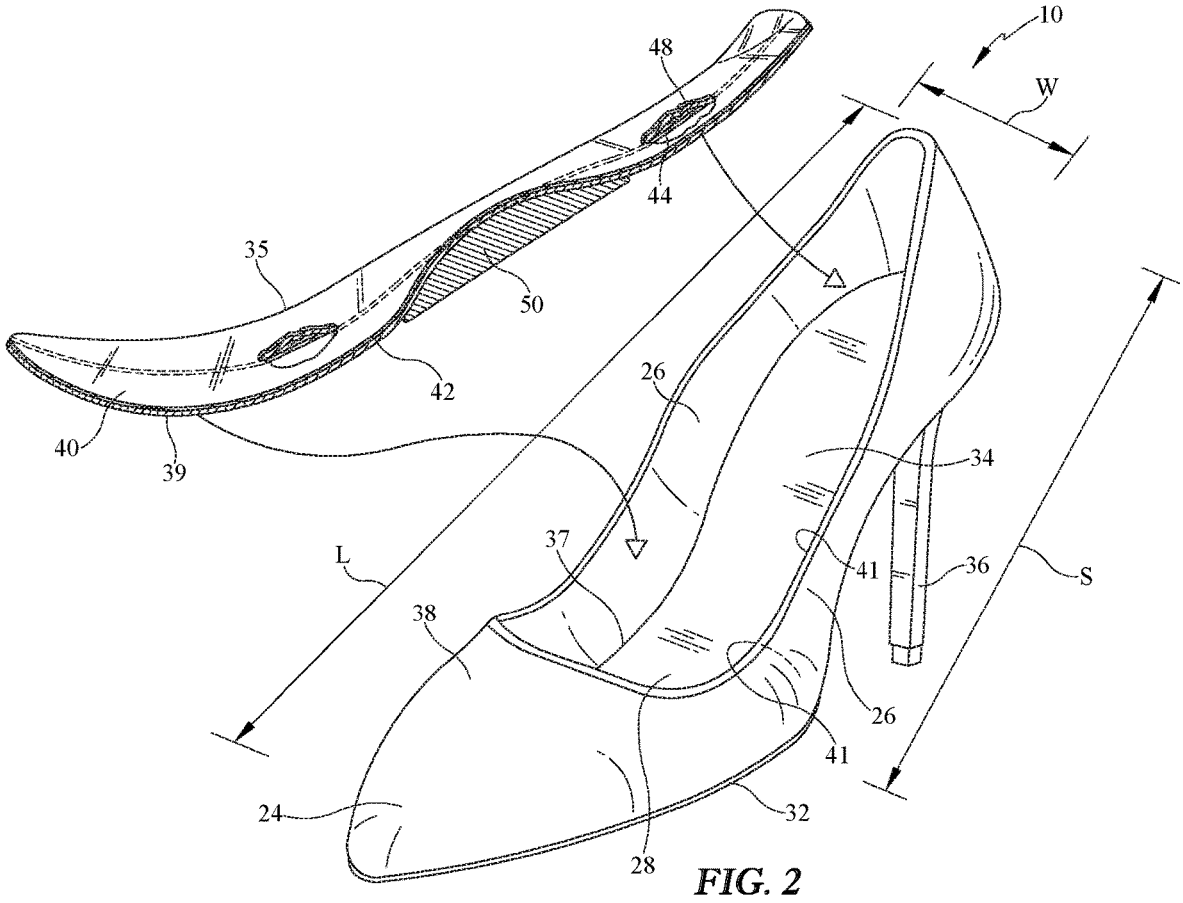
FIG. 2 is the disassembled view of FIG. 1 further showing a cross-sectional view of the orthotic insole taken along the line 2-2 in FIG. 1.
Figure 3:
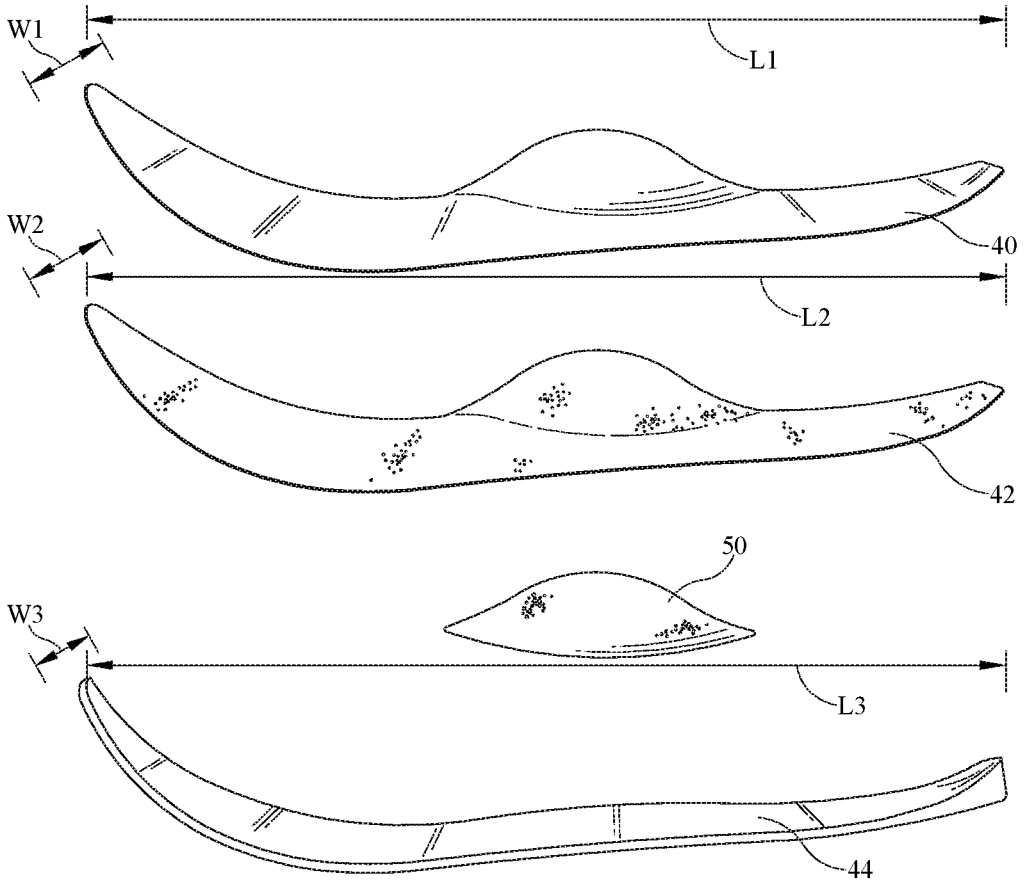
FIG. 3 is an exploded view of a full-length orthotic insole according to the exemplary embodiment as illustrated in FIG. 1.

In an exemplary embodiment, as shown in FIGS. 1-3, a women's shoe 10 generally includes an insole or insert 20 and a shoe base 30. The women's shoe 10 is configured to be a heeled or elevated shoe such that the shoe base 30 includes a outsole 32, a heel 36 coupled on the bottom of the outsole 32, and an upper portion 38 (which may include a quarter or vamp portion) that extends upward from the outsole 32 away from the heel 36, as illustrated in FIG. 1. The upper portion 38 may include a toe box 24 that surrounds and contains a user's toes (not shown) when the user is wearing the women's shoe 10. The heel 36 may be configured to be similar to heels of other women's shoes as known in the industry.

The insole 20 is configured to be permanently affixed in the shoe base along a top surface 34 of the outsole 32 of the shoe base 30, as illustrated in FIG. 1. The top surface 34 of the outsole 32 comprises an outer perimeter 122 that defines the boundaries of the top surface 34 and outsole 32. The outer perimeter 122 defines the shape of the top surface 34, and may be generally shaped similar to the shape of a women's foot.

As illustrated in the exemplary embodiments and described herein, the insole 20 may be generally shaped to conform to a bottom surface of a person's foot (not shown). It is desirable that the insole 20 is of sufficient thickness and of appropriate durometer to be suitable under the stresses accompanying ordinary use of the women's shoe 10. Moreover, the insole 20 should be sufficiently flexible to permit movement during flexing of the foot and to accommodate multiple arch heights in the women's shoe 10. The insole 20 may be covered in a wrap 80 that substantially surrounds at least the top of the insole 20 for cosmetic reasons and/or comfort of the user. In illustrative embodiments, the wrap 80 may also surround the sides and/or a portion of the bottom of the insole for cosmetic purposes. In illustrative embodiments, the wrap 80 may be made of leather or other similar material, and may be created to match or coordinate with other portions of the shoe 10. In alternative embodiments, the wrap 80 may cover only the sides and a portion of the top of the insole 120, and an optional sock layer 220 may be positioned over the top of the insole 120 in order to cover the remaining portions of the 120, as is known in the art.

The insole 20 may be configured to extend varying lengths of the shoe base 30. For instance, the insole 20 may extend the full length of the outsole 32, as shown in FIGS. 1-3. Alternatively, the insole 20 may be a sulcus-length insole (not shown), extending from adjacent the user's heel to a location adjacent to where a user's digital sulcus may be positioned within the shoe 10. Other insole lengths that permit incorporation of the features herein described are also envisioned. Further, the present disclosure envisions that the shape, size and type of the insole 20 may be modified based on the shape, size and type of the shoe 10 that it will be incorporated into.

In illustrative embodiments, the insole 20 may extend substantially the full length L of the outsole 32 and span the full width W of the outsole 32; that is, the insole 20 may be a heel-to-toe and side-to-side insole as illustrated in FIGS. 1 and 2. The insole 20 may be configured to fit within, and to extend substantially between, one or more walls 26 of the upper portion 38 of the shoe 10. Accordingly, in such an embodiment, the insole 20 substantially provides complete separation between the wearer's foot and the outsole 32. In alternative embodiments, a sulcus-length insole may extend approximately a length S from the back of the outsole 32 adjacent the heel 36 to a point 28 on the outsole 32, as illustrated in FIG. 2, the point 28 positioned approximately where the user's digital sulcus may be aligned when the user wears the shoe 10.

In illustrative embodiments, the insole 20 comprises at least a top layer 40, a middle layer 42, and a bottom layer 44, as shown in FIGS. 2-3. In use, the top layer 40 is configured to be in contact with a wearer's foot (not shown), or the wrap 80 of material may be positioned between the top layer 40 and the wearer's foot. The middle layer 42 is positioned between the top layer 40 and the bottom layer 44, and the bottom layer 44 is configured to be adjacent to the outsole 32 of the shoe 10. Each of these layers 40, 42, and 44 may be manufactured separately and assembled together to form the insole 20. Each layer may be contoured to meet the shape and size of a typical underside of a foot, as illustrated in the Figures.

While it is envisioned that the layers 40, 42, and 44 may be made of various materials, in illustrative embodiments, the top layer 40 may be constructed of a garment quality leather, or similar durable and resistant material. The middle layer 42 may be constructed of a closed-cell foam material, such as, but not limited to, ethylene vinyl acetate (EVA), commercially available as P-Cell®, or polyethylene, available commercially as Plastazote®. Other foam or cushioned materials may be used in various exemplary embodiments disclosed herein. Such material should provide adequate cushioning and shock absorption, while having a high coefficient of friction to provide a secure grip. A closed-cell material may also prevent irritation to a wearer as it is less abrasive from other materials. The bottom layer 44 may be constructed of a foam material, such as a closed-cell foam material, for example, ethylene vinyl acetate.

In illustrative embodiments, the top layer 40 may be configured to have a length L1 and a width W1, the length L1 being substantially similar to the length L of the insole 20 and the width W1 being substantially similar to the width W of the insole 20.

In various embodiments, the middle layer 42 may be approximately ⅛ inches thick, and have a durometer measurement of approximately 20. The middle layer 42 may have a length L2 and a width W2. The length L2 may be substantially similar to the length L of the insole 20 and length L1 of the top layer 40, and the width W2 may be substantially similar to the width W of the insole 20 and the width W1 of the top layer 40. The middle layer 42 may be configured to make the insole 20 moldable to each individual's foot, while the middle layer 42 may still be very light weight. In various embodiments, the middle layer 42 may have varying thickness along the length L2 of the middle layer 42. In addition, the middle layer 42 is envisioned to be fairly resistant to deformation, minimally abrasive, deflective of moisture, and a higher tensile strength.

The bottom layer 44 may have a length L3 that is substantially similar to lengths L, L1, and L2 of the insole 20, top layer 40, and middle layer 42, respectively. However, the bottom layer 44 may include a width W3 that is smaller than the widths W, W1 and W2 of the insole 20, top layer 40, and middle layer 42, respectively. As illustrated in FIGS. 2 and 3, the width W3 may be approximately equal to, or less than, half of the width W of the whole insole 20. In illustrative embodiments, the width W3 is configured to extend and cover the lateral column of a wearer's foot (not shown). The bottom layer 44 may be positioned along an outside edge 35 of the insole 20, the outside edge 35 corresponding to the outside of a wearer's foot (not shown) and an outer side 37 of the upper portion 38 of the shoe base 30.

The bottom layer 44 may be configured to be a more rigid than the middle layer 42, and may have a durometer of 55, which may provide more motion control. In illustrative embodiments, the bottom layer 44 may be 1/16 inches thick.

In illustrative embodiments, the bottom layer 44 comprises a rearfoot post 48, as illustrated in FIG. 3. In illustrative embodiments, the rearfoot post 48 is a lateral rearfoot post. The rearfoot post 48 is configured to provide balance to the foot and ankle of the wearer, and to further reduce lateral column overload of the foot. In an illustrative embodiment and for purposes of a women's high-heel shoe 10, the rearfoot post 48 may be a 3-degree post as known to be determined in the industry. A 3-degree rearfoot post is a biomechanically accepted rearfoot wedge size tolerated by most people to discourage the subtalar and ankle joints from inverting, by directing ground reactive forces laterally. Such a design reduces the tendency to twist or sprain an ankle. This feature is helpful in combination with a high-heel shoe, as the heel causes the arch to elevate naturally. The rearfoot post 48 may be positioned along the outsole 32 and extend the length L of the insole 20 from the heel 36 of the shoe base 30. The rearfoot post 48 may be configured as a wedge of orthotic material added to control excess rearfoot frontal plane movement.

The exemplary insole 20 further includes an arch fill 50, as illustrated in FIGS. 1-3. The arch fill 50 is not the full length of the insole 20, but rather is only configured to be positioned under a wearer's arch along an inner edge 39 of the insole 20 and adjacent to an inner side 41 of the upper portion 38 of the shoe base 30. In illustrative embodiments, the arch fill 50 may be made of Microcell Puff, an ethylene vinyl acetate foam, or other similar material, and may be of variable measurements based on the shoe size. The arch fill 50 may have a durometer measurement of 35. The arch fill 50 may be configured for some flexibility while also providing rigidity and resistance to deformation.

In illustrative embodiments, the bottom layer 44 of the insole 20 may partially overlap the arch fill 50 when assembled together in the insole 20. The bottom layer 44 may extend under the lateral column of the wearer, while the arch fill 50 extends below at least the entire arch of the wearer. In this manner, the bottom layer 44 may extend over a portion of the arch fill 50 by a length of E.

Figure 4:
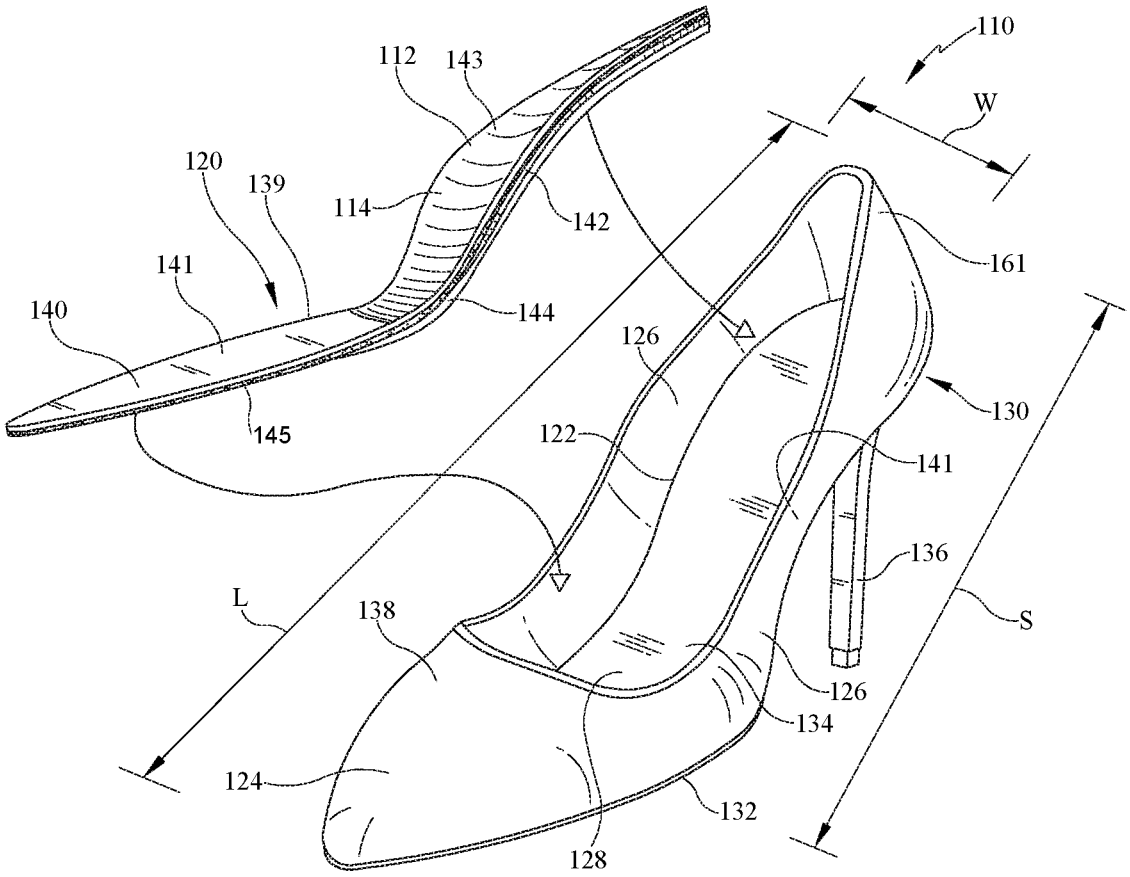
FIG. 4 is a disassembled view of a women's left high heel shoe with a full-length orthotic insole according to a second exemplary embodiment.

In illustrative embodiments, the upper portion 38 of the shoe 10 may further include a heel counter 60. The heel counter 60 is an upwardly extending support on the back of the upper portion 38 above the heel 36. The heel counter 60 provides support for the heel of the wearer of the shoe 10 by wrapping around a portion of the wearer's heel and/or ankle, as illustrated in FIGS. 1 and 4. The heel counter 60 is configured to be similar to heel counters known in the industry.

The combination of the arch fill 50 and rearfoot post 48 together provide an appropriate support for the foot and ankle of the wearer of the high-heel shoe 10. Specifically, the addition of the arch fill 50 provides a natural support for a wearer's arch (both natural and created from the high-heel shoe), which the rearfoot post 48 provides a counter-balance to the forces on the wearer's ankle and heel that can cause ankle sprains or injuries. These features in combination provide beneficial support for high-heel shoes.

In illustrative embodiments, this combination may be enhanced with the heel counter 60. In combination with a heel counter 60 that restricts movement of the wearer's foot and ankle in the shoe 10, the features of the present disclosure provide additional beneficial support for high-heel shoes.

In a second exemplary embodiment, as shown in FIGS. 4-8B, a women's high-heel shoe 110 generally includes an insole or insert 120 and a shoe base 130. The women's shoe 110 is configured to be a heeled or elevated shoe such that the shoe base 130 includes a outsole 132, a heel 136 coupled on the bottom of the outsole 132, and an upper portion 138 (which may include a quarter or vamp portion) that extends upward from the outsole 132 away from the heel 136, as illustrated in FIG. 4. The upper portion 138 may include a toe box 124 that surrounds and contains a user's toes (not shown) when the user is wearing the women's shoe 110. Alternatively, the upper portion 138 may include an open-toe feature. The heel 136 may be configured to be similar to heels of other women's shoes as known in the industry. The insole 120 include a medial or inside edge 139 and a lateral or outside edge 145.

The insole 120 is configured to be permanently affixed in the shoe base along a top surface 134 of the outsole 132 of the shoe base 130, as illustrated in FIG. 4. As illustrated in the exemplary embodiments, the insole 120 may be generally shaped to conform to a bottom surface of a person's foot (not shown). It is desirable that the insole 120 is of sufficient thickness and of appropriate durometer to be suitable under the stresses accompanying ordinary use of the women's shoe 10. Moreover, the insole 120 should be sufficiently flexible to permit movement during flexing of the foot and to accommodate multiple arch heights in the women's shoe 110. The insole 120 may be covered in a wrap 180 that substantially surrounds at least the top of the insole 120 for cosmetic reasons and/or comfort of the user. In illustrative embodiments, the wrap 180 may also surround the sides and/or a portion of the bottom of the insole for cosmetic purposes. In illustrative embodiments, the wrap 180 may be made of leather or other similar material, and may be created to match or coordinate with other portions of the shoe 110. In alternative embodiments, the wrap 180 may cover only the sides and a portion of the top of the insole 120, and an optional sock layer 220 may be positioned over the top of the insole 120 in order to cover the remaining portions of the 120, as is known in the art.

The insole 120 may be configured to extend varying lengths of the shoe base 130. For instance, the insole 120 may extend the full length of the outsole 132, as shown in FIG. 4. Alternatively, the insole 120 may be a sulcus-length insole (not shown), extending from adjacent the user's heel to a location adjacent to where a user's digital sulcus may be positioned within the shoe 110. Other insole lengths that permit incorporation of the features herein described are also envisioned. Further, the present disclosure envisions that the shape, size and type of the insole 120 may be modified based on the shape, size and type of the shoe 110 that it will be incorporated into.

In illustrative embodiments, the insole 120 may extend substantially the full length L of the outsole 132 and span the full width W of the outsole 132; that is, the insole 120 may be a heel-to-toe and side-to-side insole as illustrated in FIG. 4. The insole 120 may be configured to fit within, and to extend substantially between, one or more walls 26 of the upper portion 138 of the shoe 110. Accordingly, in such an embodiment, the insole 120 substantially provides complete separation between the wearer's foot and the outsole 132. In alternative embodiments, a sulcus-length insole may extend approximately a length S from the back of the outsole 132 adjacent the heel 136 to a point 128 on the outsole 132, as illustrated in FIG. 4, the point 128 positioned approximately where the user's digital sulcus may be aligned when the user wears the shoe 110.

The insole 120 may be configured to include an arch support 112 positioned along the medial or inner edge 139 of the insole 120. The arch support 112 may be configured to be positioned under a wearer's arch along the inner edge 139 of the insole 120 and adjacent to an inner side 141 of the upper portion 138 of the shoe base 130. In illustrative embodiments, the arch support 112 and the rest of the insole 120 may be formed as a single unitary structure, or the arch support 112 may be formed as a separate structure and coupled to the rest of the insole 120. The arch support 112 may accordingly be made of the same material as the rest of the insole 120 or of different material, and may be of variable measurements based on the shoe size. The arch support 112 may be configured for some flexibility while also providing rigidity and resistance to deformation.

Figure 5A:
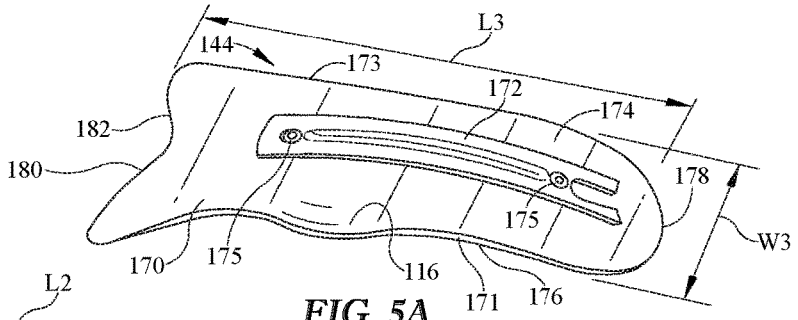
FIGS. 5A-5C are bottom perspective, exploded views of three layers of the orthotic insole of FIG. 4.
Figure 5B:
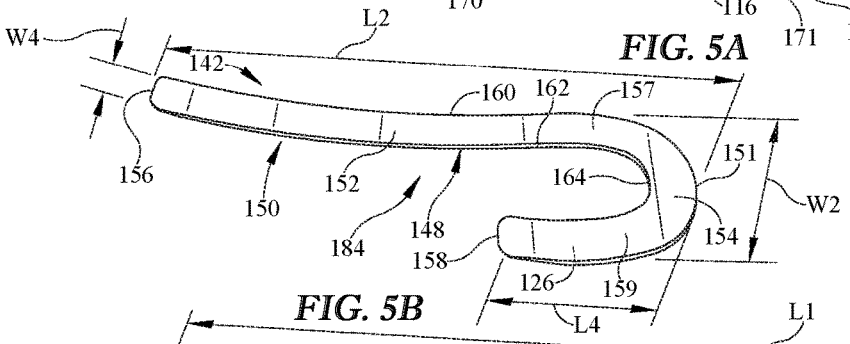
Figure 5C:
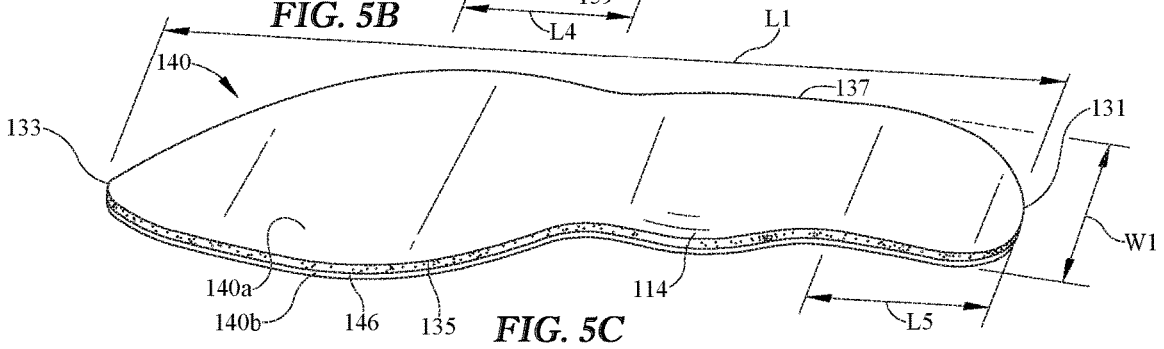
Figure 6:
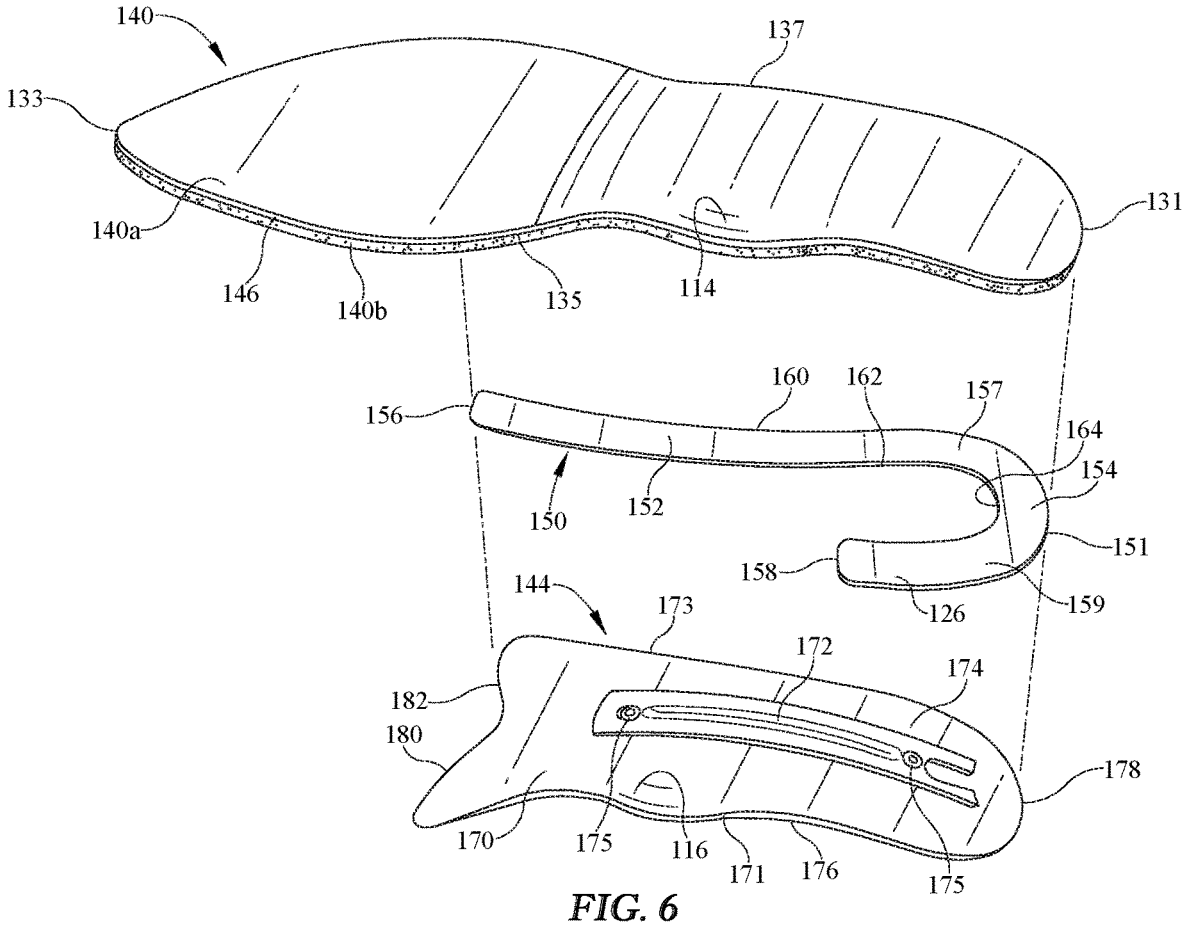
FIG. 6 is an illustrative assembly view of the three layers of the insole as illustrated in FIGS. 5A-5C according to one embodiment.

In illustrative embodiments, the insole 120 comprises at least a top layer 140, a middle layer 142, and a bottom layer 144 as shown in FIGS. 5A-6. In use, the top layer 140 is configured to be in contact with a wearer's foot (not shown), or the wrap 180 of material may be positioned between the top layer 140 and the wearer's foot. The middle layer 142 is positioned between the top layer 140 and the bottom layer 144, and the bottom layer 144 is configured to be adjacent to the outsole 132 of the shoe 110. Each of these layers 140, 142, and 144 may be manufactured separately and assembled together to form the insole 120. Each layer may be contoured to meet the shape and size of a typical underside of a foot, as illustrated in the Figures. It is envisioned that the layers 140, 142, and 144 may be made of the same material or different materials.

In illustrative embodiments, the top layer 140 includes a first end 131, a second end 133, a medial or in inner edge 135, and a lateral or outer edge 137, as illustrated in FIG. 5C. The first end 131 of the top layer 140 is generally configured to be positioned adjacent to or below a wearer's heel, the second end 133 is generally configured to be positioned adjacent to or below a wearer's toes, the inner edge 135 is generally configured to be positioned adjacent to or below the medial or inside edge of a wearer's foot, and the outer edge 137 is generally configured to be positioned adjacent to or below the lateral or outside edge of a wearer's foot. The top layer 140 may be configured to have a length L1 and a width W1, the length L1 being substantially similar to the length L of the insole 120 and the width W1 being substantially similar to the width W of the insole 120. The top layer 140 comprises an outer perimeter 146 that defines the boundaries of the top layer 140 and spans across the first end 131, second end 133, inner edge 135, and outer edge 137. The outer perimeter 146 defines the shape of the top layer 140, and may be generally configured to be similar in shape to the outer perimeter 122 of the top surface 34 of the outsole 32. In various embodiments, the top layer 140 includes a slight protrusion 114 positioned on the inner edge 135 that corresponds with the arch support 112 of the insole 120, as illustrated in FIG. 5C.

In illustrative embodiments, the top layer 140 may be constructed of one or more materials suitable to support a wearer's foot. For instance, the top layer 140 may be constructed of a garment quality leather, or similar durable and resistant material. The top layer 140 may alternatively be constructed of a rubber or other flexible material. The top layer 140 may further be constructed of a cardboard or other similar stiffing material. In illustrative embodiments, and as illustrated in FIG. 5C, the top layer 140 may be constructed of a first sublayer of material **140*a* and a second sublayer of material 140*b*. The first sublayer 140*a* may be positioned on top of the second sublayer 140*b*, adjacent to the wearer's foot when the insole 120 is positioned in the shoe 110. The second sublayer 140*b* may be positioned adjacent to the middle layer 142 when the insole 120 is assembled. In various embodiments, the first sublayer 140*a* may be made of a flexible rubber or cushioning material, and the second sublayer 140*b* may be constructed from a stiffer material such as cardboard or the like. In alternative embodiments, the first sublayer 140*a* may comprise a first portion 141 and a second portion 143, as illustrated in FIGS. 4 and 5C. The first portion 141 and second portion 143 may be joined together to form sublayer 140*a* such that first portion 141 and second portion 143 each have lengths that are less than the length L1 of the top layer 140. In various embodiments, the first portion 141 may be constructed of a flexible foam material or rubber material, while the second portion 143 may be constructed of a stiffer material such as cardboard or the like. Other embodiments of sublayers 140*a* and 140*b*** are envisioned herein.

In illustrative embodiments, the middle layer 142 of the insole 120 comprises one or more pieces of material that form a j-strip 150. The j-strip 150 comprises a first straight portion 152, a curved portion 154, and an optional second straight portion 126, as illustrated in FIG. 5B. In illustrative embodiments, the j-strip 150 may be formed of a single piece of material that is shaped as described herein. Alternatively, the j-strip 150 may be formed of multiple pieces of material that combine to form the shape as described herein. The description and drawings of a single piece j-strip 150 are applicable to a j-strip 150 formed of multiple pieces.

In illustrative embodiments, the first straight portion 152 is joined with the curved portion 154 and the second straight portion 126 to form the j-strip 150. The first straight portion 152 includes a first end 156 and a connecting edge 157 that is spaced apart from the first end 156. The second straight portion includes a connecting edge 159 and a second end 158 that is spaced apart from the connecting edge 159. The curved portion 154 is coupled to the connecting edges 157 and 159 to connect the first straight portion 152 and the second straight portion 126. The first straight portion 152, curved portion 154 and second straight portion 126 are configured to be coupled together to form the j-strip 150.

In various embodiments, the first straight portion 152, the curved portion 154, and the second straight portion 126 form a continuous j-strip 150 of a single material. In other embodiments, these components may be formed separately and connected together, or the components may be formed separately and positioned adjacent to each other to form the j-strip 150. The first end 156 of the first straight portion 152 and the second end 158 of the second straight portion 126 form the ends of the j-strip 150. In illustrative embodiments, the first end 156 and the second end 158 of the middle layer 142 may taper to a thin edge, as illustrated in FIG. 5B, in order to minimize the transition from the middle layer 142 in order to provide comfort for the wearer.

The middle layer 142 comprises an outer edge 160 that defines the outer boundaries of the middle layer 142. The outer edge 160 extends from the first end 156 to the second end 158 of the j-strip 150, and extends along the straight portions 152, 126 and curved portion 154 of the j-strip 150. The outer edge 160 defines the outer perimeter of the j-strip 150, and may be generally shaped to conform in shape and size to a portion of the outer perimeter 146 of the top layer 140, as illustrated in FIGS. 6-8B, as well as the outer perimeter 122 of the top surface 34 of the outsole 32. The middle layer 142 further includes an inner edge 162 that extends from the first end 156 to the second end 158 of the j-strip 150, as illustrated in FIG. 5B. The inner edge 162 comprises a curved edge 164 that corresponds with the curved portion 154 of the j-strip 150. The curved portion 154 of the j-strip is configured to be positioned below the heel of a wearer's foot and provides approximately 180 degrees of curvature for the j-strip 150. Accordingly, the j-strip 150, and in particular the curved edge 164 of the inner edge 162, provides a cupping effect to the user's heel to maintain the heel in a pre-determined position within the shoe.

The middle layer 142 may have a length L2 and an overall width W2, as illustrated in FIG. 5B, wherein the length L2 is smaller than the length L1 of the top layer 140 while the overall width W2 may be similar is size as the width W1 of the top layer 140. The overall width W2 may be defined relative to the outer edge 160 of the j-strip 150. The length L2 is the distance from the first end 156 to a bottom point 151 of the j-strip 150 along the curved portion 154. The length L2 may be determined by the distance from the heel of a wearer to approximately the joint of the fifth metatarsal bone (e.g. sulcus-length).

As illustrated in FIG. 5B, the length of the first straight portion 152 is configured to be larger than the length of the second straight portion 126 such that the first end 156 is not aligned with the second end 158. Accordingly, the first straight portion 152 extends generally along a substantial portion of the lateral edge of a wearer's foot, while the second straight portion 126 does not extend along a substantial portion of the medial edge of the wearer's foot. Thus, when assembled in the insole 120, the middle layer 142 causes a variance in thickness across the width of the insole 120—i.e. the lateral edge 145 of the insole 120 may be thicker than the medial edge 139 of the insole 120. This causes a posting or raised effect for the wearer's foot on the lateral edge of the wearer's foot as compared to the medial edge of the wearer's foot when the wearer's foot is in the shoe. The j-strip shape of the j-strip 150 effectively promotes such an effect on only one side, namely, the lateral side, of the insole 120.

In various embodiments, the j-strip 150 provides for increased stability for a wearer of the shoe in light of the variance in thickness of the insole 120 between the medial edge 139 and the lateral edge 145. Specifically, the difference between the thickness of the insole 120 along the lateral edge 145 verses the thickness of the insole 120 along the medial edge 139 creates a rearfoot posting effect for the wearer of the shoe. For example, in illustrative embodiments, the first straight portion 152 of the middle layer 142 comprises a lateral rearfoot post 148. The rearfoot post 148 is configured to provide balance to the foot and ankle of the wearer, and to further reduce lateral column overload of the foot. In an illustrative embodiment and for purposes of a women's high-heel shoe 10, the rearfoot post 148 may be a 3-degree post as known to be determined in the industry. A 3-degree rearfoot post is a biomechanically accepted rearfoot wedge size tolerated by most people to discourage the subtalar and ankle joints from inverting, by directing ground reactive forces laterally. Such a design reduces the tendency to twist or sprain an ankle. This feature is helpful in combination with a high-heel shoe, as the heel causes the arch to elevate naturally. The rearfoot post 148 may be configured as a wedge of orthotic material added to control excess rearfoot frontal plane movement.

In illustrative embodiments, the first straight portion 152 and second straight portion 126 are configured to extend to specific points along a standard wearer's foot. Specifically, the first straight portion 152 is configured to be aligned along the outside edge 137 of the insole 120, which corresponds to an outside edge of a wearer's foot. The first straight portion 152 may be configured to extend to approximately below the joint of the fifth metatarsal bone of a typical women's foot along the outside edge 137 of the insole 120. The second straight portion 126 is configured to be aligned along the inside edge 139 of the insole 120, which corresponds to an inside edge of the wearer's foot. The second straight portion 126 may be configured to extend to at or just before the arch support 112 of the insole 120 (and accordingly the arch of the wearer's foot). As illustrated in FIGS. 5A-5B, the second straight portion 126 may extend a distance L4 that is less than a length L5 from the heel of the insole 120 to the beginning of the arch support 112.

The first straight portion 152 may include a width W4 that is smaller than the widths W of the insole 120 or W2 of the middle layer 142, respectively. As illustrated in FIGS. 5B and 6, the width W4 may be less than half of the width W2 of the middle layer 142. In illustrative embodiments, the width W4 is configured to extend across a portion of the lateral column of a wearer's foot (not shown). The straight portion 152 is configured to be positioned along an outside edge 35 of the insole 120, the outside edge 35 corresponding to the outside of a wearer's foot (not shown) and the outer side 137 of the upper portion 138 of the shoe base 130.

The bottom layer 144 of the insole 120 may be configured to be a more rigid than the middle layer 142, and may have a durometer of 55, which may provide more motion control. In illustrative embodiments, the bottom layer 144 may be 1/16 inches thick. In various embodiments, the bottom layer includes a slight protrusion 116 that corresponds with the arch support 112 of the insole 120, as illustrated in FIG. 5A.

In illustrative embodiments, the bottom layer 144 includes a base 170 and a rigid plate 172 fixedly secured to the base 170, as illustrated in FIG. 5A. The base 170 includes a top surface 174, a bottom surface 176, a first end 178, a second end 181, an inner edge 171, and an outer edge 173. The first end 178 of the bottom layer 144 is generally configured to be positioned below a wearer's heel, the second end 181 is generally configured to be positioned below and inward of a wearer's toes, the inner edge 171 is generally configured to be positioned below the inside portion of a wearer's foot, and the outer edge 193 is generally configured to be positioned below the outside portion of a wearer's foot. The top surface 174 is configured to be positioned adjacent to the middle layer 142, while the bottom surface 176 is configured to be positioned adjacent to the outsole of the shoe 110.

In illustrative embodiments, the second end 181 of the base 170 may taper to a thin edge 182, as illustrated in FIG. 5A, in order to minimize the transition from the bottom layer 144 in order to provide comfort for the wearer. In various embodiments, the base includes the protrusion 116 along the inner edge 171 that corresponds with the arch support 112, and is configured to align with the protrusion 114 of the top layer 140 when the insole 120 is assembled. The first end 178 may be shaped to correspond to the first end 131 of the top layer 140, the inner edge 171 may be shaped to partially correspond to the inner edge 135 of the top layer 140, and the outer edge 173 may be shaped to partially correspond to the outer edge 137 of the top layer 140.

Figure 7:
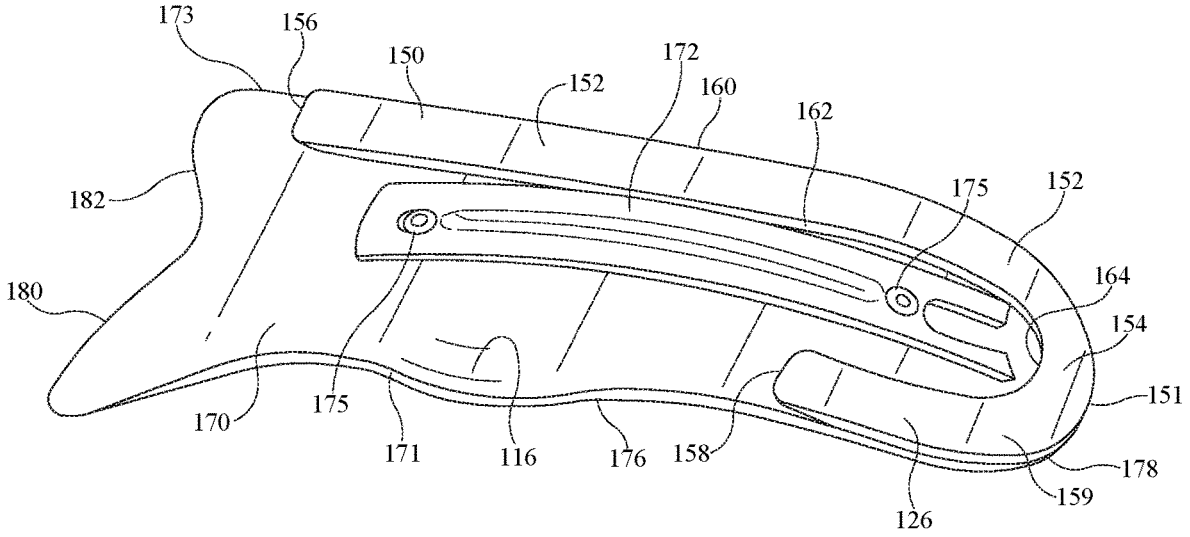
FIG. 7 is an assembled view of a middle layer and a bottom layer of the insole of FIG. 4.

The rigid plate 172 is coupled to the top surface 174 of the base 170. The rigid plate 172 may be configured to extend away from the top surface 174 in the middle of the rigid plate 172 when the ends of the rigid plate 172 are coupled to the top surface 174, as illustrated in FIG. 5A. In various embodiments, the rigid plate 172 is an elongated and slightly curved member that is secured to the top surface 174 of the base 170 via rivets or similar connecting members 175. As illustrated in FIG. 7, the rigid plate 172 may be positioned on the base 170 such that the rigid plate 172 aligns with a cavity 184 formed in the j-strip 150 between the first straight portion 152 and the second straight portion 126. As is known in the industry, the rigid plate 172 may provide additional resistance and stability to the shoe, or further provide means for shaping and/or flexing of the insole 120 to a desired shape and height of the shoe, as well as means for providing a spring or bias force to the wearer's foot from the insole 120 during use.

The base 170 may have a shape that conforms in part to the shape of a portion of the top layer 140, and may generally have a width W3 that is substantially similar to the width W1 of the top layer 140. The base 170 may have a length L3 that is less than the length L1 of the top layer 140, but is equal to or greater than the length L2 of the middle layer 142. Other alternatives for the length and width of the bottom later 144 are envisioned herein. In various embodiments, the base 170 may have a length L3 that extends from the heel of the wearer to generally just past the pivot point of the joint of the fifth metatarsal bone. In alternative embodiments, the base 170 may have a length L3 that is sulcus length.

Figure 8A:
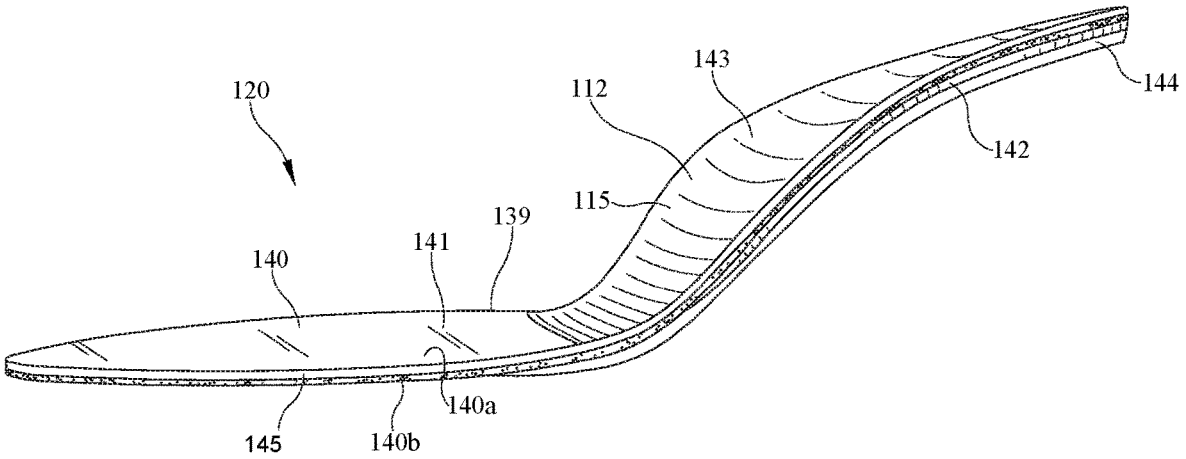
FIGS. 8A-8B are side perspective views of the insole of FIG. 4.
Figure 8B:
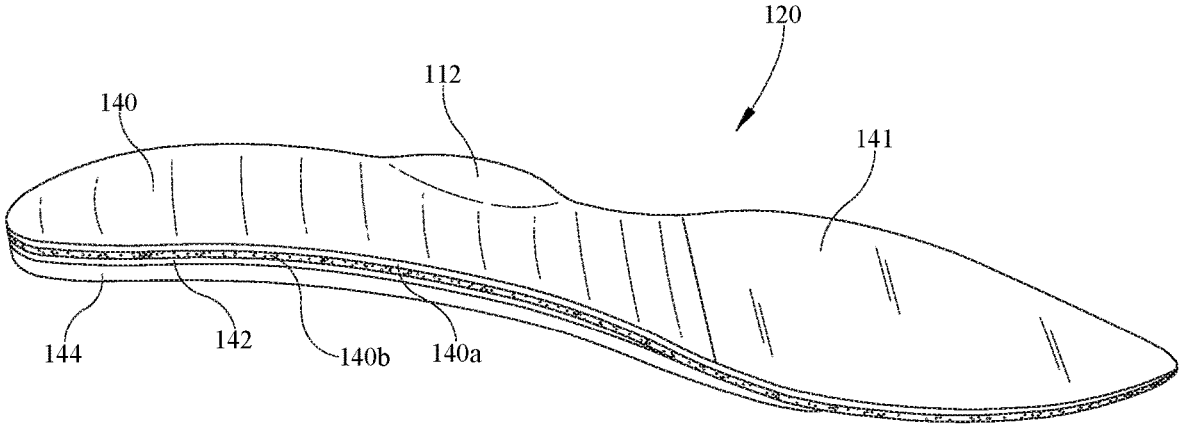

An exemplary embodiment of a method of making the insole 120 of the second embodiment for a women's high-heel shoe 110 includes positioning the middle layer 142 between the bottom layer 144 and the top layer 140, as illustrated in FIG. 6, and assembling the layers 140, 142 and 144 together to form a single insole 120, as illustrated in FIGS. 8A-8B. The middle layer 142 is configured to include a rearfoot posting 148 that provides, for example, a 3-degree wedge to diminish or prevent lateral column loading to the wearer's foot. The middle layer 142 may include a first straight portion 152 configured to have a smaller width W4 than the rest of the insole 20 such that the first straight portion 152 only extends to cover the width of a wearer's lateral column, while the width W of the insole 120 may extend the entire width W of a wearer's foot. The insole 120 may be combined with a shoe base 130 that includes a heel counter 161 along the back of the shoe base 130, the heel counter 60 restraining movement of the wearer's heel while the wearer's foot is in the shoe 110.

Figure 9:
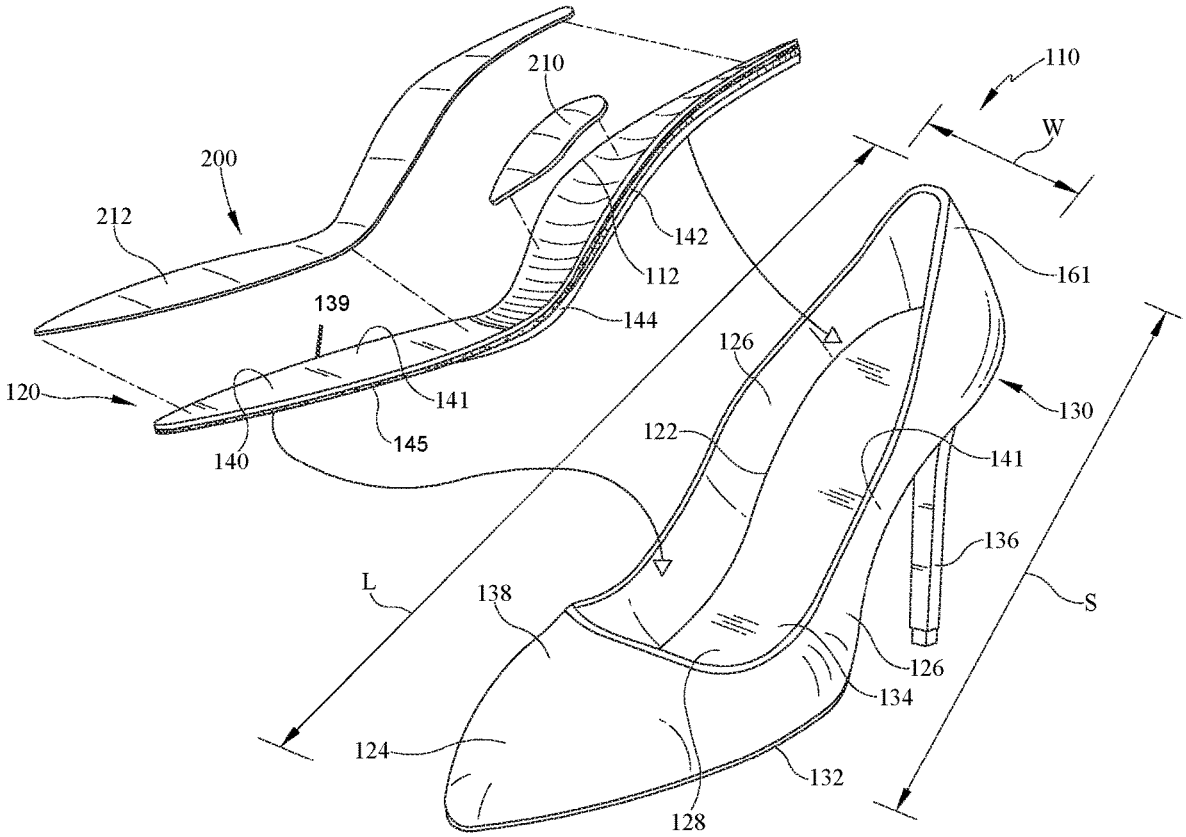
FIG. 9 is a disassembled view of a women's left high heel shoe with a full-length orthotic insole including an optional cushioning layer, according to a third exemplary embodiment.
Figure 10:
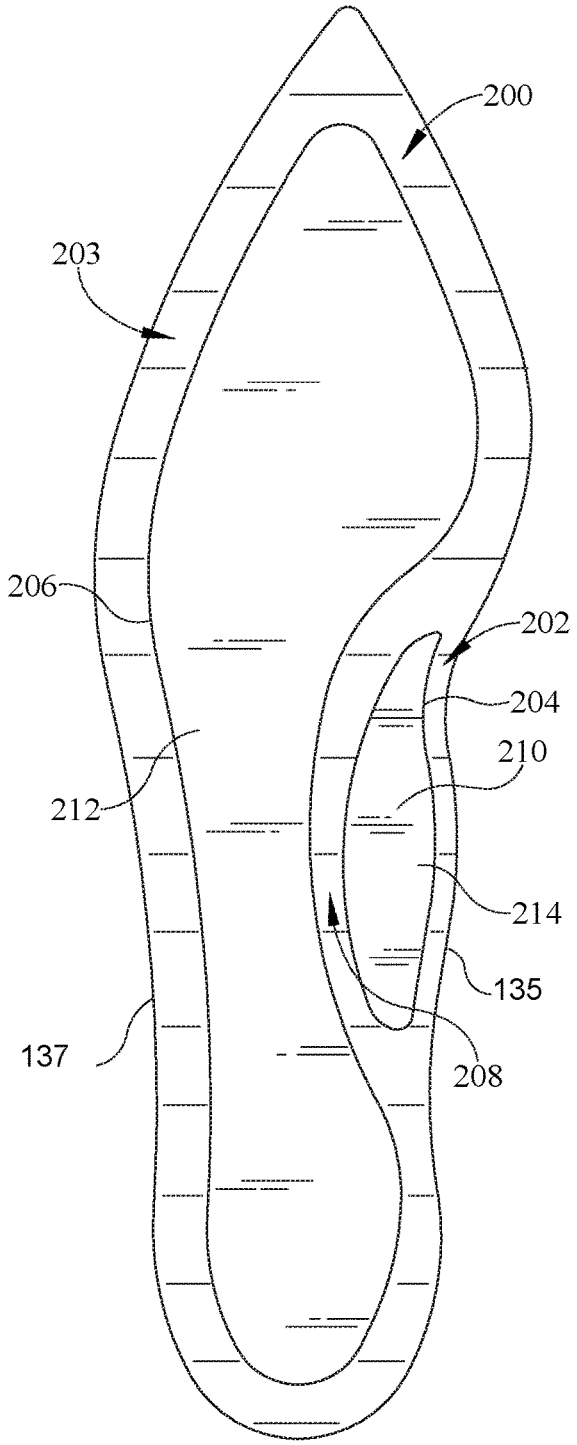
FIG. 10 is a top perspective view of the insole and cushioning layer of FIG. 9.
Figure 11:
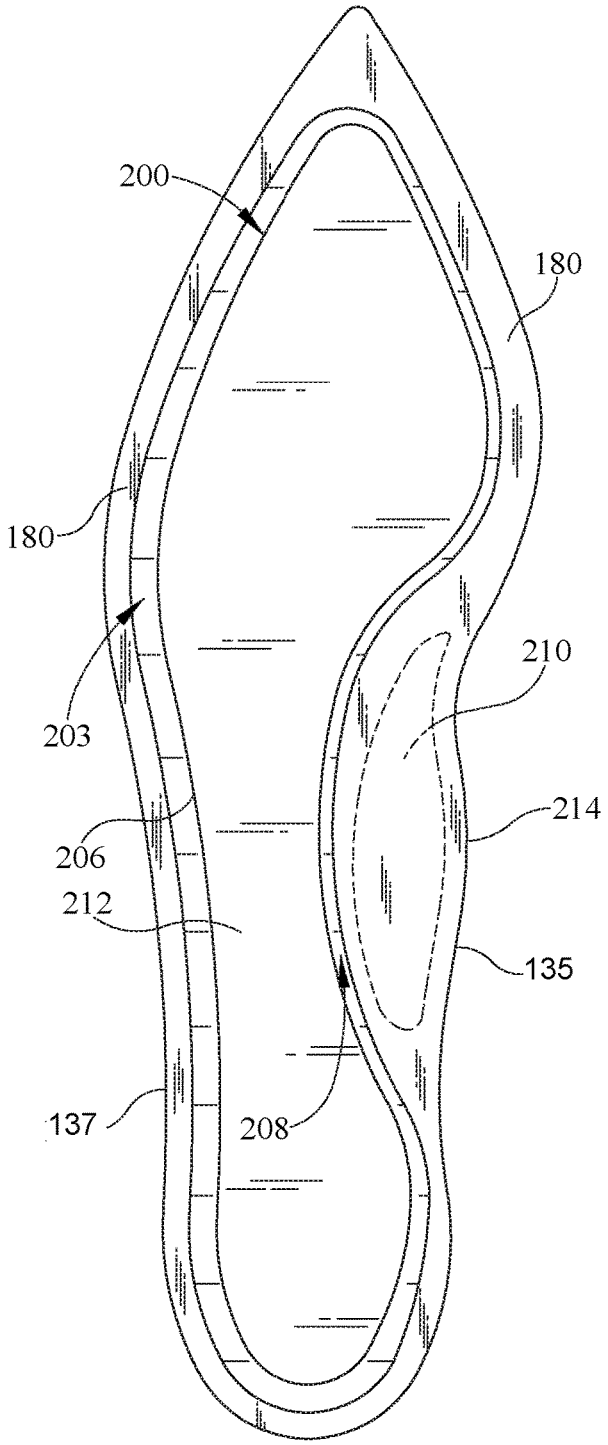
FIG. 11 is a top perspective view of the insole of FIG. 10 after an optional wrap has been applied to a portion of the insole.

In a third exemplary embodiment, as shown in FIGS. 9-11, the high-heel shoe 110 may optionally include a cushioning layer 200 that is positioned adjacent to or above the insole 120 described herein. In illustrative embodiments, the cushioning layer 200 may be positioned on top of the top layer 140. The cushioning layer 200 may be constructed of a closed-cell foam material, such as, but not limited to, ethylene vinyl acetate (EVA), commercially available as P-Cell®, or polyethylene, available commercially as Plastazote®. Other foam or cushioned materials may be used in various exemplary embodiments disclosed herein. Such material should provide adequate cushioning and shock absorption, while having a high coefficient of friction to provide a secure grip. A closed-cell material may also prevent irritation to a wearer as it is less abrasive from other materials.

As illustrated in FIGS. 10-11, the cushioning layer 200 may be comprised of one or more separate pads of material that have a shape that is partially dependent on the shape or size of the insole 120. The cushioning layer 200 may be configured to extend varying lengths of the insole 120. For instance, the cushioning layer 200 may extend the full length of the insole 120, or may extend less than the full length of the insole 120. The cushioning layer 200 may have a width W5 that is slightly smaller than the width W1 of the insole 120, and may have a length L5 that is slightly smaller than the length L1 of the insole 120. Accordingly, a gap 202 may be formed between a medial edge 204 of the cushioning layer 200 and the medial edge 135 of the top layer 140 of the insole 120, and a gap 203 may be formed between a lateral edge 206 of the cushioning layer 200 and the lateral edge 137 of the top layer 140, as illustrated in FIG. 10. Alternatively, cushioning layer 200 may extend the full width between edges 135 and 137, and the full length between the ends 131 and 133 of the top layer 140.

In various embodiments, cushioning layer 200 may be comprised of a first cushion segment 210 and a second cushion segment 212, as illustrated in FIG. 10. The first cushion segment 210 may be positioned to be above the arch support 112 of insole 120 along a medial side of the insole 120 corresponding with the inner edge 139 of the insole 120. The first cushion segment may further include a slight protrusion 214 that corresponds to the shape of the slight protrusion 114 of the top layer 140. The first cushion segment 210 may be shaped to conform generally with the arch of a wearer's foot. The first cushion segment 210 may have a width W6 that is less than the width W5 of the cushion segment 210 and a length L6 that is less than the length L5 of the cushion segment 210. In various embodiments, the first cushion segment 210 may be thicker than the second cushion segment 212.

The second cushion segment 212 may be positioned to be below the plantar aspect of the foot sparing the arch, as illustrated in FIG. 10, and may be shaped to generally correspond with the plantar aspect of the foot (minus the arch). In various embodiments, the second cushion segment 212 and first cushion segment 210 are configured to be generally in the same plane of alignment with each other so that the first cushion segment 210 and second cushion segment 212 form cushioning layer 200 on top of top layer 140. First cushion segment 210 and second cushion segment 212 may be spaced apart from each other such that a gap 208 is formed between first cushion segment 210 and second cushion segment 212. Alternatively, first cushion segment 210 may overlap a portion of second cushion segment 212, or second cushion segment 212 may overlay a portion of first cushion segment 210, on top of top layer 140.

In various embodiments, cushioning layer 200 may include multiple segments that are positioned on top of top layer 140. For instance, first or second cushioning segments 210 or 212 may be comprised of two or more separate segments of material such that cushioning layer 200 is formed of three or more segments of material. Alternatively, cushioning layer 200 may be comprised of a single layer of cushion material.

Cushioning layer 200 may be applied to insole 120 of shoe 110 in a variety of methods. Cushioning layer 200 may be applied before or after insole 120 is affixed to other components of shoe 110, such as the heel 136 and the upper portion 138. Cushioning layer 200 may alternatively be applied to the top layer 140 before the top layer 140 is coupled to the middle layer 142 and the bottom layer 144 of the insole 120. Other methods of applying cushioning layer 200 to the insole 120 are envisioned herein.

In one illustrative method of preparing the shoe 110, first cushioning segment 210 may be coupled to the top layer 140 of the insole 120 above the arch support in a first step, and then a wrap 180 of material may be applied over a portion of the first cushioning segment 210 and the sides of insole 120, as illustrated in FIG. 11. The wrap 180 may be formed of a leather or leather like material, and may extend around the full circumference of the insole 120. Alternatively, the wrap 180 may only extend around a portion of the circumference of the insole 120. The wrap 180 may provide a finished surface for the wearer's foot to rest upon when wearing the shoe 110. In a second step, the insole 120 (with the first cushioning segment 210) may then be fixedly secured to other components of the shoe 110, such as the heel 136 and upper portion 138. After the insole 120 is affixed to other portions of the shoe 110, the second cushioning segment 212 may be affixed to the plantar aspect of the foot sparing the arch in a third step. The second cushioning segment 212 may be applied directly to the top layer 140, or may partially lay over the first cushioning segment and/or the wrap 180. An optional sock layer 220 may be applied over the second cushioning segment 212 in a last step and may further overlap a portion of the wrap 180 and/or second cushioning segment 212.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. It is intended that the specification and examples be considered as exemplary only, with a true scope and spirit being indicated by the following inventive concepts.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

The headings of various sections are used for convenience only and are not intended to limit the scope of the present disclosure.

Throughout the description and claims of this specification, the word "comprise" and variations of the word, such as "comprising" and "comprises," means "including but not limited to," and is not intended to exclude, for example, other additives, components, integers or steps. "Exemplary" or "illustrative" means "an example of" and is not intended to convey an indication of a preferred or ideal embodiment. "Such as" is not used in a restrictive sense, but for explanatory purposes.

It should further be noted that any patents, applications and publications referred to herein are incorporated by reference in their entirety.

What is claimed is:

1. An insole, comprising:

a top layer;

a middle layer, wherein the middle layer comprises a first straight portion and a curved portion adjacent to the straight portion, wherein the first straight portion is positioned along a lateral edge of the insole that corresponds to a lateral edge of a wearer's foot and the curved portion is positioned adjacent the back of the insole that corresponds to a wearer's heel; and a bottom layer, wherein the bottom layer is a base positioned directly beneath the entire middle layer, the bottom layer having a first width, wherein the entire insole extends a first length, wherein an entire length of the middle layer that extends along the lateral edge of the insole is a second length and the entire length of the middle layer that extends along the lateral edge is a second width that is less than the first width of the bottom layer, wherein an entire length of the middle layer that extends along a medial edge of the insole that corresponds to a medial edge of a wearer's foot is a third length, wherein the first length and second length are substantially similar, and wherein the third length is less than the first or second lengths.

2. The insole of claim 1, wherein the insole further includes an arch support along a medial edge of the insole.

3. The insole of claim 2, wherein the top layer includes a protrusion that corresponds to the arch support, and wherein the bottom layer includes a protrusion that corresponds with the arch support.

4. The insole of claim 1, wherein the top layer comprises two sublayers of material of different material, and wherein the two sublayers overlap each other within the top layer.

5. The insole of claim 1, wherein the middle layer is formed as a j-shaped strip.

6. The insole of claim 5, wherein the j-shaped strip further includes a second straight portion adjacent to the curved portion and wherein the second straight portion extends along a medial edge of the insole to a terminal end of the second straight portion, the medial edge of the insole corresponds to a medial edge of a wearer's foot, and wherein the second straight portion does not extend a substantial distance along the medial edge of the insole.

7. The insole of claim 6, wherein the insole further includes an arch support.

8. The insole of claim 7, wherein the second straight portion does not extend past the arch support.

9. The insole of claim 1, wherein the bottom layer further comprises a rigid plate coupled to the base.

10. The insole of claim 9, wherein the rigid plate is configured to fit within a cavity of the middle layer formed between the straight portion and the curved portion.

11. The insole of claim 1, wherein the straight portion of the middle layer provides a rearfoot posting.

12. The insole of claim 1, wherein the curved portion is configured to provide a cupping effect to the wearer's heel.

13. The insole of claim 1, wherein the top layer extends a first length and the middle layer extends a second length, wherein the first length is longer than the second length.

14. A high-heel women's shoe, comprising an insole comprising a top layer, a middle layer, and a bottom layer, wherein the middle layer is formed as a j-shaped strip and comprises a first straight portion forming a first terminal end of the j-shaped strip, a curved portion adjacent to the first straight portion, and a second portion adjacent to the curved portion forming a second terminal end of the j-shaped strip, wherein the first straight portion is positioned along an edge of the insole that corresponds to the lateral edge of a wearer's foot and the curved portion is positioned adjacent the back of the insole that corresponds to a wearer's heel, and the second portion is positioned along an edge of the insole that corresponds to the medial edge of a wearer's foot, a length from the curved portion to the second terminal end being shorter than a length from the curved portion to the first terminal end, and wherein the insole comprise an arch support;

an outsole configured to permanently receive the insole within the shoe; and wherein the middle layer is configured to provide a lateral rearfoot posting, wherein the insole is a non-removable insole permanently fixed in the high-heel women's shoe.

15. The shoe of claim 14, wherein the shoe further includes a cushioning layer positioned on top of the top layer.

16. The shoe of claim 15, wherein the cushioning layer includes a first cushion segment and a second cushion segment.

17. The shoe of claim 16, wherein the first cushion segment is positioned to be below the wearer's arch and the second cushion segment is positioned to be below the plantar aspect of the wearer's foot, sparing the arch.

18. The shoe of claim 16, wherein a gap is formed between the first and second cushion segments.

19. The shoe of claim 16, wherein shoe further includes a wrap that partially covers a portion of the first cushion segment.

20. The shoe of claim 14, wherein the first terminal end and the second terminal end of the j-shaped strip each taper to a relatively thin edge compared to a thickness along the first straight portion and second portion.

21. The shoe of claim 14, wherein the first straight portion includes an outer edge that is shaped and sized to conform along a substantial portion of the lateral edge of the wearer's foot.

* * * * *